US006755990B1

(12) United States Patent
van den Berg et al.

(10) Patent No.: US 6,755,990 B1
(45) Date of Patent: Jun. 29, 2004

(54) MONOPROPELLANT SYSTEM

(76) Inventors: Ronald Peter van den Berg, Oosteinde 23 A, NL-2548 AK, Den Haag (NL); Petrus Johannes Maria Elands, Zomerlust 35, NL-2804 LK, Gouda (NL); Johannes Maria Mul, Duvenvoordestraat 8, NL-2012 AE, Haarlem (NL)

( * ) Notice: Subject to any disclaimer, the term of this patent is extended or adjusted under 35 U.S.C. 154(b) by 0 days.

(21) Appl. No.: 09/673,441

(22) PCT Filed: Apr. 14, 1999

(86) PCT No.: PCT/NL99/00216

§ 371 (c)(1),
(2), (4) Date: Mar. 19, 2001

(87) PCT Pub. No.: WO99/52839

PCT Pub. Date: Oct. 21, 1999

(30) Foreign Application Priority Data

Apr. 15, 1998 (EP) ..... 98201190

(51) Int. Cl.[7] ..... C09K 3/00; C06B 47/08; C06B 25/34

(52) U.S. Cl. ..... 252/188.1; 149/36; 149/92

(58) Field of Search ..... 44/458, 265, 266; 252/188.1; 149/36, 92

(56) References Cited

U.S. PATENT DOCUMENTS 5,976,483 A * 11/1999 Langlet ..... 423/385
6,254,705 B1 7/2001 Anflo et al. ..... 149/1

* cited by examiner

*Primary Examiner*—Cephia D. Toomer
(74) *Attorney, Agent, or Firm*—Burns Doane, Swecker & Mathis, L.L.P.

(57) ABSTRACT

"The invention is directed to a monopropellant composition for propulsion and/or gas generation, comprising a solution of hydrazinium nitroformate (HNF) and/or ammonium dinitramide (ADM) in water and/or an alkanol."

43 Claims, 1 Drawing Sheet

MONOPROPELLANT SYSTEM

BACKGROUND OF THE INVENTION

The present invention is in the area of monopropellant composition systems, for instance for spacecraft propulsion, in emergency systems for jet fighters or in emergency gasgeneration systems for submarines.

Spacecraft propulsion is defined as that needed for the orientation (attitude control) and positioning (orbit control including de-orbiting) of spacecraft after delivery into the required orbit by the launch vehicle. It is quite separate and distinct from launcher propulsion. The need for spacecraft propulsion beings with its separation from the launch vehicle and terminates at the end of its useful service life. It is usually the depletion of the spacecraft's propellant that terminates its mission.

Typical requirements for attitude and orbit control are very low thrust (0.1 N typically), a pulsed operational mode for attitude control, a continuous operational mode for orbit control and accurate and repeatable performance and reliable leak-free operation. For de-orbiting the thrust can be higher.

The propulsion in this area is amongst others generated by so-called monopropellant thrusters, wherein a propellant is catalytically or thermally decomposed into hot gases which are then expanded through a nozzle. In the area of monopropellants hydrogen peroxide and hydrazine are presently traditionally used. They provide a specific impulse of respectively 1872 and 2266 m/s at an expansion ratio of 50, zero ambient pressure, chamber pressure of 1 MPa and at chemical equilibrium outflow conditions.

Both systems have, however, some drawbacks. Hydrogen peroxide is known for its instability and autodecomposition behaviour. Drawbacks of hydrazine are its toxicity and flammability.

These aspects of currently used monopropellants accordingly require high level, and thus costly, requirements for production, transport, storage, handling and disposal.

The same problems are encountered in emergency systems for jet fighters (emergency start-up of engine after flame-out) and submarines (emptying ballast tanks in emergency situation by generating gas).

SUMMARY OF THE INVENTION

It is one of the objects of the present invention to provide a monopropellant composition for spacecraft propulsion and the other uses described above, which obviates these drawbacks of the prior art system. It is a further object to provide a stable, clean, less toxic, and/or less flammable monopropellant composition. It is also an object to provide a monopropellant composition for spacecraft propulsion that could contribute to a relaxation of requirements and therefore to a reduction of costs and launch preparation time.

The present invention is based on the surprising finding that known solid high energy oxidisers such as hydrazinium nitroformate and ammonium dinitramide, when dissolved in water provide a liquid monopropellant system having a specific impulse that could be equal to the specific impulse of the conventional monopropellants, without having the disadvantage thereof.

The invention is accordingly directed to a solution of hydrazinium nitroformate (HNF) and/or ammonium dinitramide (AND) in water and/or a lower alkanol as monopropellant composition, especially in spacecraft propulsion.

The amount of water and/or lower alkanol in the system should be such that the system is liquid, which determines the lower level of the amount of water. On the other hand there should be sufficient hydrazinium nitroformate (HNF) and/or ammonium dinitramide (AND) present in the system to provide the required impulse. Accordingly, the amount of HNF and/or ADM is from 25 to 95 wt. % of the composition. Due to the nature of spacecraft propulsion, this specific impulse of the propellant system should be as high as possible, in order to prolong the lifetime of the satellite.

DESCRIPTION OF THE PREFERRED EMBODIMENT

Figure 1:
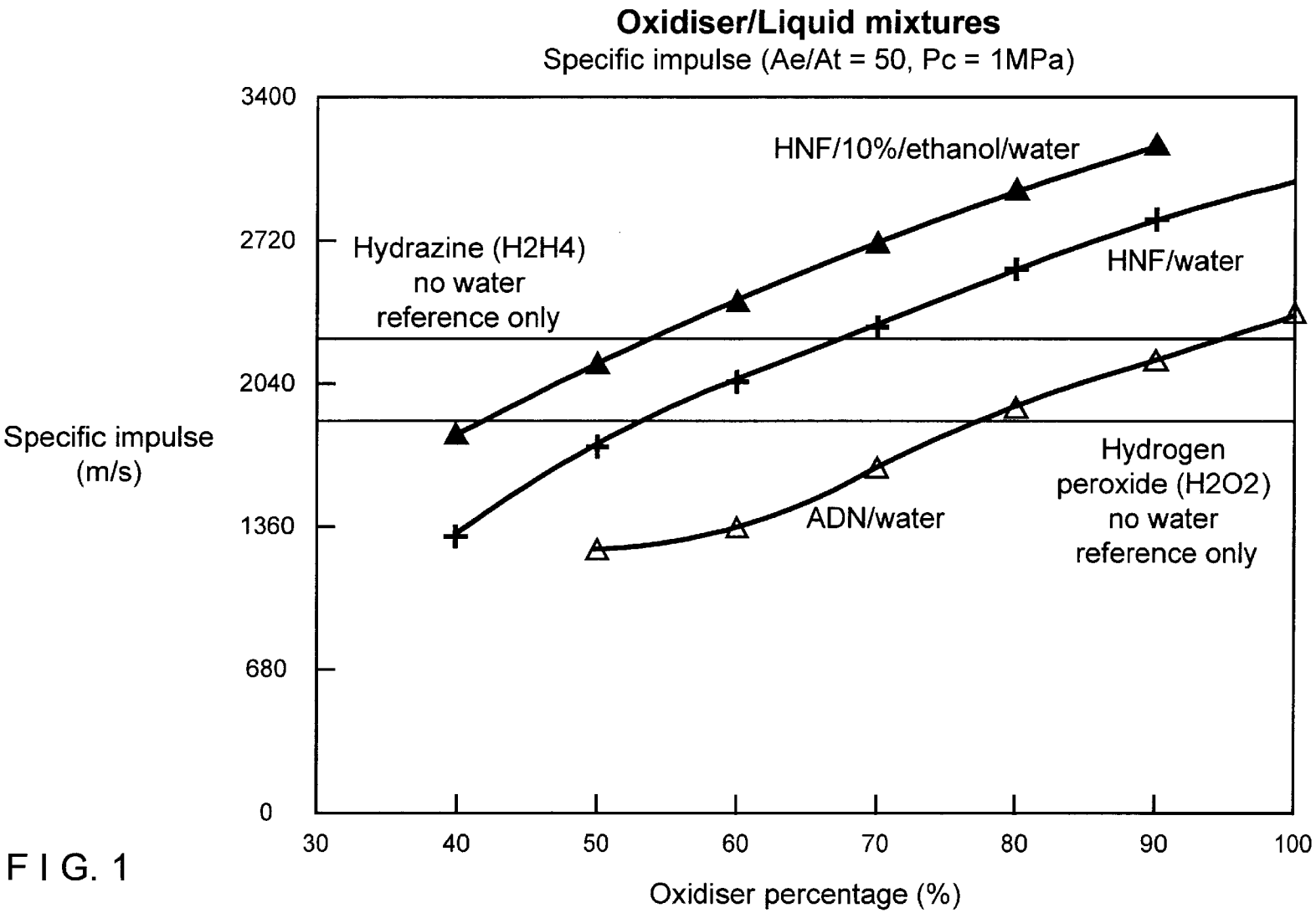
FIG. 1 graph showing a comparison of specific impulse of various propellant systems.

According to a preferred embodiment hydrazinium nitroformate in water is used. In another embodiment of the propellant system according to the invention additionally an amount of an organic solvent, for example a lower alkanol, such as methanol, ethanol, propanol or butanol, can be used. It has been found that this increases the specific impulse of the monopropellant. The amount of alkanol in the solution is preferably between 0 and 70 wt. %, whereas methanol and/or ethanol are preferred.

An especially preferred system consists of 25 to 75 wt. % of hydrazinium nitroformate, 5 to 50 wt. % of water and 0 (more preferred 5 ) to 25 wt. % of lower alkanol.

In accordance with the invention it is also possible to include other additives in the propellant system, including, but not limited to solubilisers, vapour pressure decreasing agents and performance improving agents.

In another embodiment the present invention is directed to a process for orienting and positioning of spacecraft after delivery into the required orbit by a launch vehicle using a spacecraft propulsion system based on monopropellant thrusters, wherein the monopropellant discussed hereinabove is used for propulsion.

Hydrazinium nitroformate and ammonium dinitramide are known high energy solid oxidisers. The use of hydrazinium nitroformate as ingredient in high performance propellant combinations for rocket engines is for example disclosed in European patent application 350,136. A production process for hydrazine nitroformate is further disclosed in the international patent application WO-A 9410104. Ammonium dinitramide is also a know material, the production of which is for example disclosed in WO-A 9424073.

The monopropellants according to the invention can be used in the conventional way for spacecraft propulsion, in existing systems, whereby it is to be noted that due to the properties of the system, less strict requirements concerning storage, transport and handling are possible. Also the use of the monopropellant system as emergency propellant in jet fighters and emergency gas generation systems for submarines is within the scope of the present invention.

The specific impulse of various monopropellant systems in accordance with the invention has been compared with the values for an aqueous solution of ammonium dinitramide and hydrazinium nitroformate in water, at 50 wt. % water. In the following table and in the figure the specific impulse is given for a expansion ratio of 50 and a chamber pressure of 1 MPa, zero ambient pressure and at chemical equilibrium outflow conditions.

TABLE 1

| Ingredient | Specific Impulse m/s | |
|---|---|---|
| | Based on 50% water and 50% oxidiser | For the pure oxidiser |
| Hydrazinium Nitroformate (HNF) | 1754 | 2950 |
| Ammonium Dinitramide (ADN) | 1267 | 2319 |
| Hydrogen Peroxide ($H_2O_2$) | 1972 | |
| Hydrazine ($N_2O_4$) | 2266 | |

As can be seen in the table 50% oxidisers/water mixtures result in a performance loss compared to hydrogen peroxide and hydrazine. This performance loss may be acceptable in view of the reduction of cost due to simpler procedures for production, transport, storage, handling and disposal. Furthermore, by increasing the amount of dissolved oxidiser the performance can be further increased. If fuels such as lower alkanols are added, performance equal to or even exceeding the performance of hydrazine is possible.

In the attached figure the specific impulse is given for various compositions of hydrazinium nitroform in water, using various concentrations, ammonium dinitramide in water using various concentrations and for a combination of hydrazinium nitroform, ethanol and water.

What is claimed is:

1. A liquid monopropellant composition for propulsion and/or gas generation, comprising a solution of hydrazinium nitroformate (HNF) in water and/or solvent, and wherein the amount of HNF is from 25 to 95 wt. % of the monopropellant composition.

2. Monopropellant composition according to claim 1, comprising water and an amount of a solvent.

3. Monopropellant composition according to claim 2, wherein the solvent is an alkanol.

4. Monopropellant composition according to claim 3, wherein the alkanol is methanol and/or ethanol.

5. Monopropellant composition according to claim 3, wherein the amount of alkanol is at most 70 wt. %.

6. Monopropellant composition according to claim 1, consisting of 25 to 75 wt. % of hydrazinium nitroformate, 5 -50 wt. % of water and 0 to 25 wt. % of a $C_1$–$C_4$ alkanol.

7. Monopropellant composition according to claim 1, further comprising solubilisers, vapour pressure decreasing agents and/or performance improving agents.

8. Process for orienting and positioning of spacecraft after delivery into a normal orbit by a launch vehicle, wherein a spacecraft propulsion system based on monopropellant thrusters, orients and positions the spacecraft, wherein the monopropellant used for propulsion comprises a solution of hydrazinium nitroformate in water and/or a solvent, and wherein the amount of HNF is from 25 to 95 wt. % of the monopropellant composition.

9. Monopropellant composition according to claim 2, wherein the solvent is a $C_1$–$C_4$ alkanol.

10. Monopropellant composition for propulsion and/or gas generation, comprising a solution of hydrazinium nitroformate (HNF) and ammonium dinitramide (ADN), in water and/or a solvent, and wherein the amount of HNF and ADN, if from 25 to 95 wt. % of the monopropellant composition.

11. Process for propulsion and/or gas generation, said process comprising generating a gas using a monopropellant composition, said composition comprising a solution of hydrazinium nitroformate (HNF) in water and/or solvent, and wherein the amount of HNF is from 25 to 95 wt. % of the monopropellant composition.

12. Process for spacecraft propulsion, said process comprising using a propellant for said propulsion, said propellant comprising a monopropellant composition, said composition comprising a solution of hydrazinium nitroformate (HNF) in water and/or solvent, and wherein the amount of HNF is from 25 to 95 wt. % of the monopropellant composition.

13. Process for providing emergency propulsion in jet fighters, said process comprising using a propellant for said propulsion, said propellant comprising a monopropellant composition, said composition comprising a solution of hydrazinium nitroformate (HNF) in water and/or solvent, and wherein the amount of HNF is from 25 to 95 wt. % of the monopropellant composition.

14. Process for emergency gas generation in submarines, said process comprising generating a gas using a monopropellant composition, said composition comprising a solution of hydrazinium nitroformate (HNF) in water and/or solvent, and wherein the amount of HNF is from 25 to 95 wt. % of the monopropellant composition.

15. The process of any of claims 8 or 11–14, wherein the monopropellant composition comprises water and an amount of a solvent.

16. The process of any of claims 8 or 11–14, wherein the monopropellant composition comprises water and amount of alkanol as a solvent.

17. The process of any of claims 8 or 11–14, wherein the monopropellant composition comprises water and amount of alkanol as a solvent, and wherein the alkanol is methanol and/or ethanol.

18. The process of any of claims 8 or 11–14, wherein the monopropellant composition comprises water and an amount of alkanol as solvent, wherein the amount of alkanol is at most 70 wt. %.

19. The process of any of claims 8 or 11–14, wherein the monopropellant composition consists of 25 to 75 wt. % of hydrazinium nitroformate, 5 -50 wt. % of water and 0 to 25 wt. % of a $C_1$–$C_4$ alkanol.

20. The process of any of claims 8 or 11–14, wherein the monopropellant composition further comprises solubilisers, vapour pressure decreasing agents and/or performance improving agents.

21. The process of any of claims 8 or 11–14, wherein the monopropellant composition comprises water and amount of a $C_1$–$C_4$ alkanol as solvent.

22. The process of any of claims 8 or 11–14, wherein the monopropellant composition is a liquid monopropellant composition.

23. The composition of claim 10, wherein the monopropellant composition comprises water and an amount of a solvent.

24. The composition of claim 10, wherein the monopropellant composition comprises water and an amount of alkanol as a solvent.

25. The composition of claim 10, wherein the monopropellant composition comprises water and an amount of alkanol as a solvent, and wherein the alkanol is methanol and/or ethanol.

26. The composition of claim 10, wherein the monopropellant composition comprises water and an amount of alkanol as solvent, wherein the amount of alkanol is at most 70 wt. %.

27. The composition of claim 10, wherein the monopropellant composition consists of 25 to 75 wt. % hydrazinium nitroformate (HNF) and ammonium dinitramide (ADN), 5 -50 wt. % of water and 0 to 25 wt. % of a $C_1$–$C_4$ alkanol.

28. The composition of claim 10, wherein the monopropellant composition further comprises solubilisers, vapour pressure decreasing agents and/or performance improving agents.

29. The composition of claim 10, wherein the monopropellant composition comprises water and amount of a $C_1$–$C_4$ alkanol as solvent.

30. The composition of claim 10, wherein the monopropellant composition is a liquid monopropellant composition.

31. Process for orienting and positioning of spacecraft after delivery into a normal orbit by launch vehicle, wherein a spacecraft propulsion system based on monopropellant thrusters, orients and positions the spacecraft, wherein the monopropellant used for propulsion comprises a solution of hydrazinium nitroformate (HNF) and ammonium dinitramide (ADN) in water and/or a solvent, and wherein the amount of HNF in combination with ADN is from 25 to 95 wt. % of the monopropellant composition.

32. Process for propulsion and/or gas generation, said process comprising generating a gas using a monopropellant composition, said composition comprising a solution of hydrazinium nitroformate (HNF) and ammonium dinitramide (ADN) in water and/or solvent, and wherein the amount of HNF in combination with ADN is from 25 to 95 wt. % of the monopropellant composition.

33. Process for spacecraft propulsion, said process comprising using a propellant for said propulsion, said propellant comprising a monopropellant composition, said composition comprising a solution of hydrazinium nitroformate (HNF) and ammonium dinitramide (ADN) in water and/or solvent, and wherein the amount of HNF in combination with ADN is from 25 to 95 wt. % of the monopropellant composition.

34. Process for providing emergency propulsion in jet fighters, said process comprising using a propellant for said propulsion, said propellant comprising a monopropellant composition, said composition comprising a solution of hydrazinium nitroformate (HNF) and ammonium dinitramide (ADN) in water and/or solvent, and wherein the amount of HNF in combination with ADN is from 25 to 95 wt. % of the monopropellant composition.

35. Process for emergency gas generation in submarines, said process comprising generating a gas using a monopropellant composition, said composition comprising a solution of hydrazinium nitroformate (HNF) and ammonium dinitramide (ADN) in water and/or solvent, and wherein the amount of HNF in combination with ADN is from 25 to 95 wt. % of the monopropellant composition.

36. The process of any of claims 31–35, wherein the monopropellant composition comprises water and an amount of a solvent.

37. The process of any of claims 31–35, wherein the monopropellant composition comprises water and an amount of alkanol as a solvent.

38. The process of any of claims 31–35, wherein the monopropellant composition comprises water and an amount of alkanol as a solvent, and wherein the alkanol is methanol and/or ethanol.

39. The process of any of claims 31–35, wherein the monopropellant composition comprises water and an amount of alkanol as solvent, wherein the amount of alkanol is at most 70 wt. %.

40. The process of any of claims 31–35, wherein the monopropellant composition consists of 25 to 75 wt. % of hydrazinium nitroformate (HNF) and ammonium dinitramide (ADN), 5 to 50 wt. % of water and 0 to 25 wt. % of $C_1$–$C_4$ alkanol.

41. The process of any of claims 31–35, wherein the monopropellant composition further comprises solubilisers, vapour pressure decreasing agents and/or performance improving agents.

42. The process of any of claims 31–35, wherein the monopropellant composition comprises water and an amount of a $C_1$–$C_4$ alkanol as solvent.

43. The process of any of claims 31–35, wherein the monopropellant composition is a liquid monopropellant composition.

* * * * *